US005976456A

United States Patent [19]

Ziani et al.

[11] Patent Number: 5,976,456

[45] Date of Patent: Nov. 2, 1999

[54] METHOD FOR PRODUCING ALUMINUM ALLOY POWDER COMPACTS

[75] Inventors: Abdelouahab Ziani, Montreal; Sylvain Pelletier, Ste. Julie, both of Canada

[73] Assignee: National Research Council of Canada, Canada

[21] Appl. No.: 09/264,689

[22] Filed: Mar. 9, 1999

Related U.S. Application Data

[60] Provisional application No. 60/077,695, Mar. 12, 1998.

[51] Int. Cl.[6] ..... B22F 1/00; B22F 3/12

[52] U.S. Cl. ..... 419/31; 419/29; 419/38; 419/47; 419/57; 148/513

[58] Field of Search ..... 419/31, 38, 47, 419/57, 29; 75/249; 148/513

[56] References Cited

U.S. PATENT DOCUMENTS

| | | | |
|---|---|---|---|
| 3,687,657 | 8/1972 | Storchheim . | |
| 3,954,458 | 5/1976 | Roberts . | |
| 4,104,061 | 8/1978 | Roberts . | |
| 5,224,983 | 7/1993 | LaSalle et al. . | |
| 5,330,704 | 7/1994 | Gilman . | |
| 5,478,220 | 12/1995 | Kamibuma et al. | 418/55.2 |
| 5,478,418 | 12/1995 | Miura et al. | 148/438 |
| 5,498,393 | 3/1996 | Horimura et al. | 419/28 |
| 5,613,189 | 3/1997 | Carden . | |
| 5,669,059 | 9/1997 | Carden et al. | 419/12 |
| 5,700,962 | 12/1997 | Carden et al. | 75/236 |
| 5,722,033 | 2/1998 | Carden et al. | 419/12 |
| 5,865,238 | 2/1999 | Carden et al. | 164/97 |

OTHER PUBLICATIONS

DAS Santosh K., "Rapid Solidification and Powder Metallurgy of Allied–Signal Inc.",The Int. Journal of Powder Metallurgy, vol. 24, No. 2, 1988, American Powder Metallurgy Institute.

Estrada, J.L.; Borrego, S.; Nicolas, E.; Duszczyk, J.; "Vacuum Degassing of Atomized Aluminum Alloys with Iron Additions", Advances in Powder Metallurgy & Particulate Materials—1996, Metal Powder Industries Federation.

Lawrence, G.D., and Foerster, G.S.—Pressureless Sintering of Aluminum Powder;, Metals Engineering Quarterly—Aug. 1971.

Kehl, W. and Fischmeister, H.F.—"Liquid Phase Sintering of Al–CU Compacts" Powder Metallurgy 1980 No. 3, p. 113.

*Primary Examiner*—Daniel J. Jenkins
*Attorney, Agent, or Firm*—H. Wayne Rock

[57] ABSTRACT

This invention relates to a method for producing sintered parts of aluminum or aluminum alloy with improved mechanical properties using batch degassing, die compaction and liquid phase sintering. The batch degassing consists of holding a prealloyed aluminum powder at a temperature of about 350° to about 450° C. in a stainless steel autoclave in which the pressure is reduced to less than $5\times10^{-6}$ torr. Once the desired pressure is reached the powder is cooled down within the autoclave while still under vacuum. The resulting powder is then compacted at a pressure of 20 to 50 tsi at between room temperature and about 250° C., but preferably at a warm temperature of about 65° C. The final densification is completed by liquid phase sintering in argon atmosphere at 625° C. This method allows the production of sintered compacts characterized by a density close to 97% of theoretical, which makes it possible to eliminate the need for a hot working step.

6 Claims, 3 Drawing Sheets

METHOD FOR PRODUCING ALUMINUM ALLOY POWDER COMPACTS

This application claims the benefit of U.S. Provisional Application No. 60/077,695 filed Mar. 12, 1998.

BACKGROUND OF THE INVENTION

1. Field of the Invention

The present invention relates to aluminum powder or aluminum alloy powder processing via die compaction and sintering, and in particular, to a method for producing high strength compacts of precipitation-hardened, and possibly dispersion-hardened type aluminum alloys.

2. Prior Art

Aluminum powder compaction and sintering when compared with iron powder processing encounters several difficulties because of the stable oxide film covering the Al powder particles. Most known sintering techniques of aluminum powder alloy compacts involve mixing aluminum powder with other metal powders such as Cu, Mg, Si, that form eutectic liquid phases during sintering. The critical parameter for aluminum powder sintering, i.e., direct metal-to-metal interface contact, has been outlined by Storchheim in U.S. Pat. No. 3,687,657 of Aug. 29, 1972. His technique emphasized that an intimate admixture of the metal powder particles with aluminum particles and a high compacting pressure (40 to 60 tons per square inch) were necessary to establish the metal-to-metal contacts. Later, Kehl and Fischmeister, *Powder Metall.,* vol.23, No. 3, (1980), pg. 113, mentioned the importance of the initial metal-to-metal contacts for completion of the sintering step. These investigators used dendritic copper particles to penetrate the oxide skin of the aluminum. They observed that the dendritic powder reacts within a few degrees above the eutectic temperature.

The oxide layer of the powdered aluminum is quite active with respect to moisture and shows a strong tendency for hydration reactions leading to the formation of both chemically bonded (hydroxides or oxi-hydroxides) and physically adsorbed water.

The prior art has demonstrated that aluminum powder degassing is essential for producing hot worked articles by extruding, forging, rolling and the like. The degassing treatment is normally conducted by exposing canned powder or a green compact to temperatures in the range of 350° to 450° C. in a partial vacuum. The degassing treatment is believed to produce a more thorough removal of contaminants from the powder surface leading to the transformation of the ductile hydroxide into brittle γ-alumina. Subjecting the degassed powder to consolidation will produce a more effective oxide break-up and as a result, an enhanced bonding of the particles is achieved, thereby improving the strength of the material.

According to conventional practice the green compacts are enclosed in welded cans and then degassed. At the completion of the degassing treatment the cans are sealed to retain the vacuum and then subjected to a combination of high temperature and pressure (hot working). Such a process is obviously complicated and, in addition to the fact that it is time consuming and costly, it doesn't offer the possibility of using net shape forming processes.

A previous investigation reported by Lawrence and Forester in *Met. Eng. Q.,* vol. 11, No. 3, (1971), pg. 113, identified the atomizing conditions that allowed the production of low oxide content powders with improved sinterability. Their work also showed that even after seven days of exposure to air at 38° C. with 100% humidity the powders were still sinterable. Accordingly, short time exposure during powder handling should not have an adverse effect on powder surface state after degassing.

SUMMARY OF THE INVENTION

The present invention provides a degassing procedure that makes aluminum or aluminum alloy powder suitable for die compaction and sintering under normal handling and storage conditions, within at least one week after the degassing treatment has been done. It is expected that the degassed powder will remain sinterable for longer periods of time unless it is subjected to a severe exposure of a warm and wet atmosphere.

The degassing procedure of this invention involves the novel step of reducing the temperature or cooling the degassed powder in a controlled manner while the powder is under vacuum. This step has resulted in improved metal-to-metal contacts after compacting, which in turn allows a higher sintering response and also eliminates a need to hot work the material as in the prior art.

Broadly speaking the present invention may be considered to provide a process for preparing compacts from aluminum powder or prealloyed aluminum powder for later sintering comprising the steps of: (a) heating a quantity of the powder in an autoclave to a degassing temperature of between about 350° and 450° C. at a pressure of about$5\times10^{-2}$ torr; (b) reducing the pressure in the autoclave to a degassing pressure of about $10^{-4}$ to about $5\times10^{-6}$ torr and maintaining the temperature in the autoclave at the degassing temperature and pressure for about 2 hours in order to degas the powder; (c) reducing the temperature in the autoclave to about room temperature while maintaining the pressure therein at the degassing pressure; (d) removing the temperature-reduced powder from the autoclave: and (e) compacting the powder after temperature reduction at a pressure of about 20 to 60 tsi and at a temperature between about room temperature and 250° C.

The present invention may also be considered as providing a process of producing sintered aluminum alloy products comprising the steps of: (a) producing a degassed aluminum or alloyed aluminum compact as described above; and (b) liquid phase sintering the compact in an inert gas atmosphere at a temperature in the range between the solidus and the liquidus temperatures for the given aluminum alloy.

BRIEF DESCRIPTION OF THE DRAWINGS

The invention will be described hereinbelow with reference to the drawings wherein.

DESCRIPTION OF THE INVENTION

The characteristics of the starting powder as used in developing the present invention are first described. That powder was supplied by Valimet, Inc. in a prealloyed form with a composition similar to the 6061 standard alloy. The typical composition is given below together with the nominal one.

TABLE 1

| ELEMENT | PRESENT ALLOY wt % | STANDARD ALLOY wt % |
|---|---|---|
| Mg | 0.97 | 0.80–1.20 |
| Si | 0.73 | 0.40–0.70 |
| Cu | 0.26 | 0.15–0.40 |
| Cr | 0.07 | 0.04–0.35 |
| Fe | 0.33 | 0.70 max |
| Zn | <0.05 | 0.25 max |
| Mn | <0.05 | 0.15 max |
| Ti | <0.05 | 0.15 max |
| Max. other (each) | <0.05 | 0.05 max |
| Max. other (total) | <0.05 | 0.05 max |
| Al | bal. | bal. |

The powder was prepared by an inert gas atomization process in which the disintegration of the melt stream was produced within a high pressure argon nozzle. The resulting shape of the powders was spherical and the mean particle size was around 100 $\mu$m. Although, in the prior art, nodular or irregular aluminum powder is preferred in terms of particle interlocking for green strength, the present degassed powder showed a comparable compressibility and an excellent green strength.

The following examples are presented to describe the degassing procedure, the compacting and sintering conditions, and the reported data set forth to illustrate the advantages of the invention.

EXAMPLE 1

Figure 1:
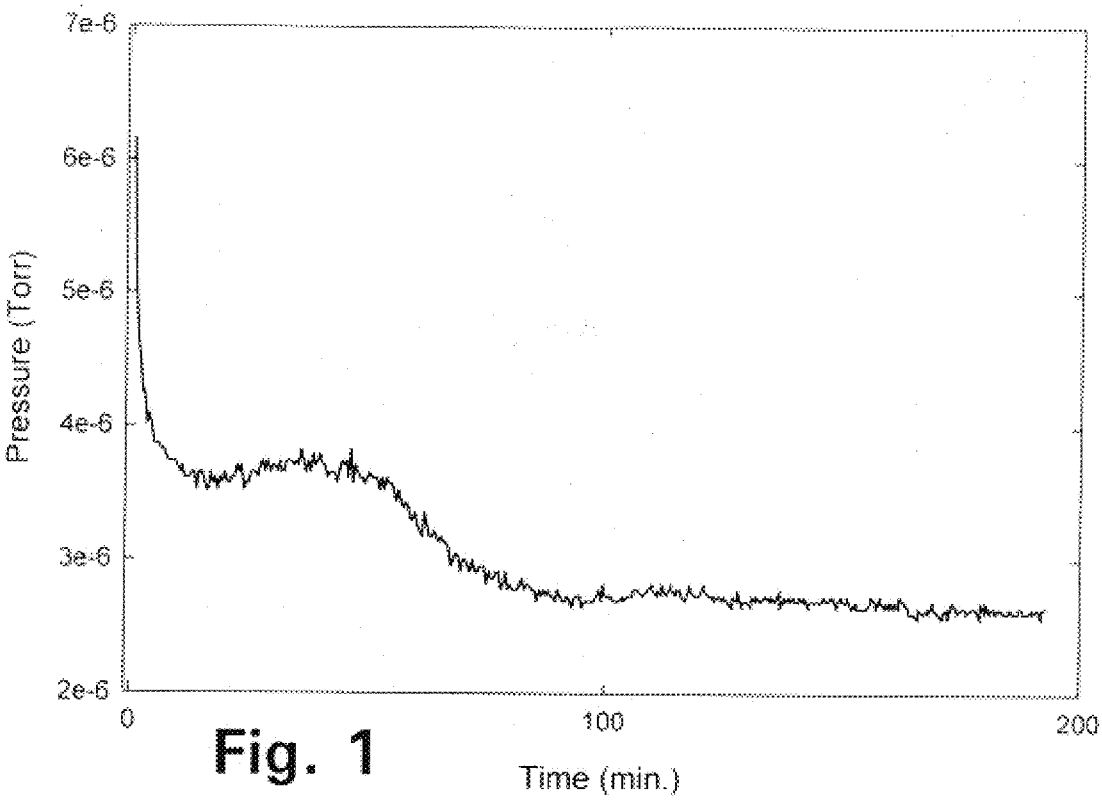
FIG. 1 is a graph of pressure within the autoclave during the degassing process.

Because of the capacity of the degassing system, this example used a 300-gram portion of powder poured in a ceramic crucible. It will be understood of course that the aforementioned capacity may be increased using appropriate equipment. For the batch degassing process disclosed herein the crucible and its powder content were enclosed in a stainless steel autoclave which was then sealed and connected to a vacuum system. During the heating stage, a primary vacuum of 0.05 torr was maintained in the autoclave. Once the temperature of the powder reached 400° C., the diffusion pump was activated to yield a secondary vacuum of about $5\times10^{-6}$ torr in 2 hours. A typical recording of the pressure within the autoclave is shown in FIG. 1. At this stage the degassing was considered to be completed and the autoclave was then withdrawn from the furnace. In accordance with this invention the powder inside was cooled down to room temperature under vacuum in order to avoid its rehydration, which is believed to be particularly severe at high temperature.

EXAMPLE 2

Compacts made from the as-received (untreated, i.e. undegassed) powder were almost laminated irrespective of the compaction condition. Furthermore, a pronounced tendency for lamination was observed when internal lubricants such as Acrawax™ C or Ceralube™ XJ-160 were added to the powder. The oxide embrittlement and the microstructure softening resulting from degassing as in Example 1 significantly improved the compacting behavior of the treated powder. After degassing, the compacts showed no surface scoring, lamination or cracks. In order to permit the formation of the desired metal-to-metal interface contacts, so as to activate sintering, it was found that the surface of the powder particles must be free from any internal lubricant. Hence only zinc stearate spray was used for die wall lubrication.

For the sake of comparison, the as-received and the degassed powders were compacted at different conditions. Due to the surface defects observed on the compacts prepared from the as-received powder, several compaction trials were made to produce the necessary number of acceptable samples.

The powder was compacted in a double action floating die on a hydraulic press into 31.7 mm×12.7 mm×6.35 mm parallelepiped samples for transverse rupture strength and density measurements. The results are summarized in Table 2.

TABLE 2

| Compacting | As-Received Powder | | | Degassed Powder | | |
|---|---|---|---|---|---|---|
| | Green Density | | TRS | Green Density | | TRS |
| Parameters | g/cm$^3$ | Percent* | MPa | g/cm$^3$ | Percent | MPa |
| 380 MPa, 25° C. | 2.51 | 93.0 | 10.08 | 2.60 | 96.3 | 22.32 |
| 380 MPa, 65° C. | 2.51 | 93.0 | 12.35 | 2.61 | 96.7 | 35.29 |
| 760 MPa, 25° C. | 2.64 | 97.8 | 19.51 | 2.68 | 99.3 | 40.36 |
| 760 MPa, 65° C. | 2.65 | 98.1 | 24.60 | 2.69 | 99.6 | 61.06 |

*The theoretical density of a 6061 Al alloy is 2.7 g/cm$^3$.

As is apparent from Table 2, the density transverse rupture strength (TRS) of the samples compacted from the degassed powder is clearly higher than that of the as-received powder. The gain in transverse rupture strength ranged from 107 to 186%, depending on compacting conditions. The observed increase in green strength is attributed to an improved bonding of powder particles, which results from a larger number of metal-to-metal interface contacts formed at places where the oxide layers have been broken up during compaction. Indeed, evidence of metal-to-metal interface contacts formation is provided by electrical resistivity measurements as shown in Table 3. There, the resistivity of compacts prepared in accordance with this invention is seen to be significantly lower as compared with the resistivity of compacts prepared without degassing.

TABLE 3

Electrical Resistivities of Degassed 6061 Al and Al (H-50 grade) Powder Compacts

| Sample Identification | Degassed 6061 Al Powder Compacts | | | | Al Powder Compacts | 6061-T6 Al Plate |
|---|---|---|---|---|---|---|
| Green Density (g/cm$^3$) | 2.60 | 2.61 | 2.68 | 2.69 | 2.69 | / |
| Resistivity ($\mu\Omega$-m) | 3.10 | 2.11 | 1.34 | 0.53 | 100.93 | 0.003 |

EXAMPLE 3

The compaction of the as-received powder into 76 mm×12.7 mm×7 mm parallelepiped samples to be used for the preparation of tensile test specimens was not successful. Most of the compacts were laminated and showed poor green strength. Moreover, separate observations of fracture surfaces revealed a strong lack of sinterability of such compacts. Subsequently, the measurement of tensile properties was restricted to the degassed powder only.

After the powder had been degassed as described hereinbefore in Example 1, it was compacted under the same conditions as in Example 2 into 76 mm×12.7 mm×7 mm parallelepiped samples for the production of tensile test specimens. The green compacts were sintered in a tubular furnace at three different temperatures: 585°,605° and 625° C. for 30 minutes in an inert (argon) atmosphere (dew point<−45° C., $O_2<10^{-7}$ ppm). The so-prepared compacts were machined into cylindrical tensile specimens according to the standard ASTM B557-94 and tested at a strain rate of $3\times10^{-4}$ $sec^{-1}$. The resulting data is listed in Table 4.

TABLE 4

| COMPACTING PARAMETERS | Sintering Temperature 585° C. YS MPa | UTS MPa | EL % | 605° C. YS MPa | UTS MPa | EL % | 625° C. YS MPa | UTS MPa | EL % |
|---|---|---|---|---|---|---|---|---|---|
| 25 tsi, 25° C. | 63.3 | 83.7 | 1.6 | 65.1 | 97.9 | 2.8 | 69.0 | 130.5 | 6.9 |
| 25 tsi, 65° C. | 70.3 | 117.5 | 5.2 | 72.8 | 121.7 | 5.1 | 72.1 | 140.1 | 10.6 |
| 50 tsi, 25° C. | 79.0 | 150.1 | 12.8 | 78.0 | 152.0 | 17.5 | 75.0 | 156.6 | 14.1 |
| 50 tsi, 65° C. | 90.8 | 156.7 | 16.8 | 75.2 | 157.0 | 22.4 | 80.5 | 168.9 | 22.2 |

YS = Yield Strength;
UTS = Ultimate Tensile Strength;
EL = Elongation

The room temperature tensile properties depend on the compacting conditions and sintering temperature. Clearly, compacts pressed at 50 tsi resulted in higher tensile properties at all sintering temperatures. Warm compaction at 65° C. also increased the strength and the ductility of the sintered material. Thus, contrary to the prior sintering practice, it has been found that high green density was preferable for the completion of the sintering step.

Figure 2:
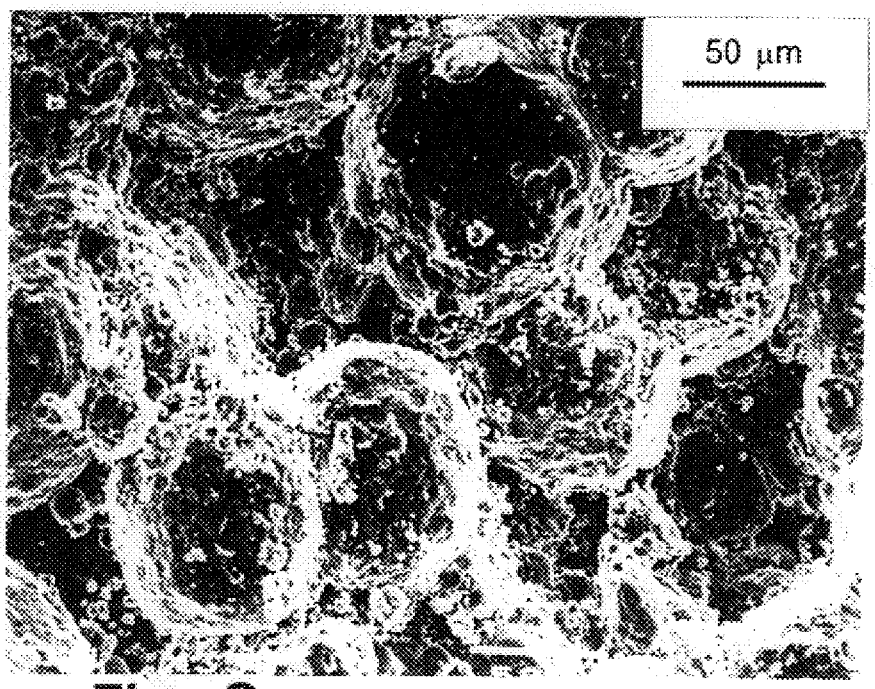
FIG. 2 is a photomicrograph of loosely packed powder particles.
Figure 3:
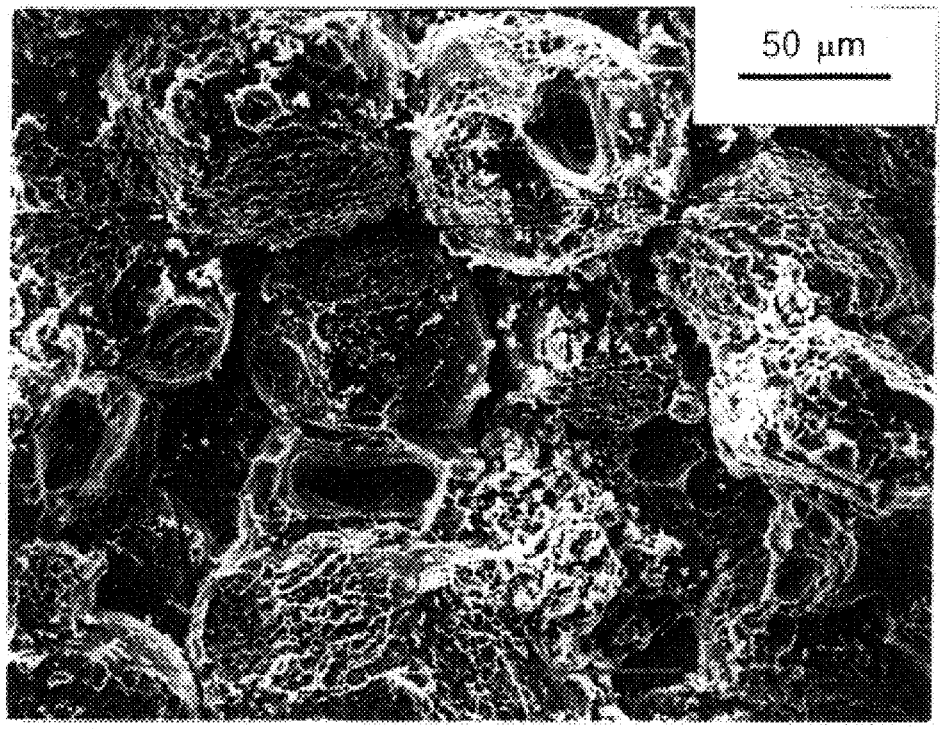
FIG. 3 is a photomicrograph showing unsintered regions in a sample with loosely packed powder particle.
Figure 4:
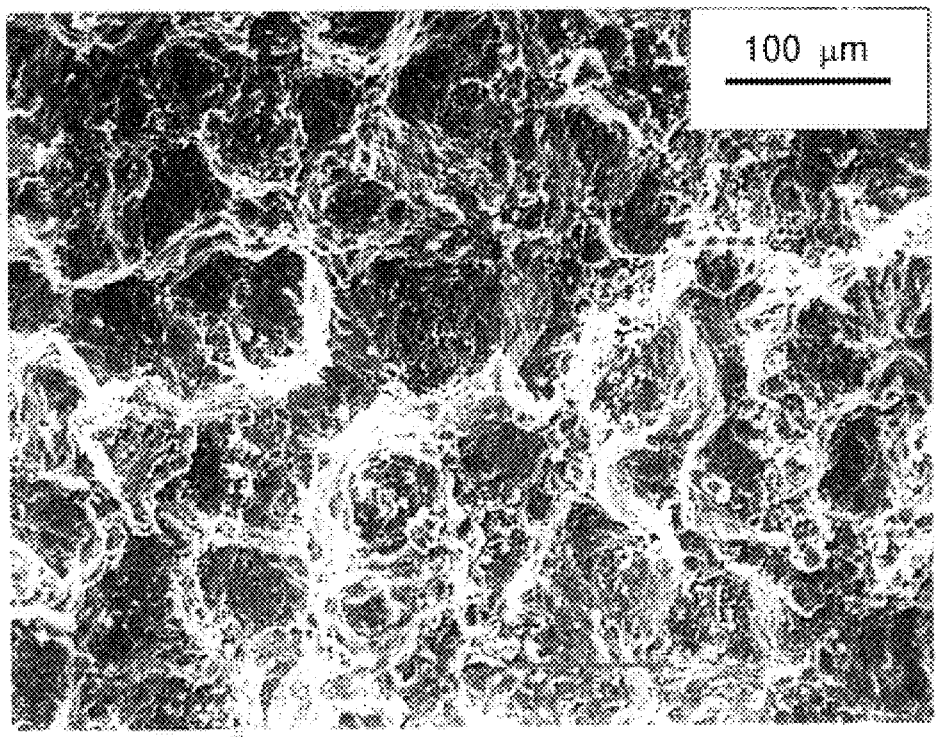
FIG. 4 is a photomicrograph of a sample sintered from a compact that was pressed at 65° C. under 50 tsi.
Figure 5:
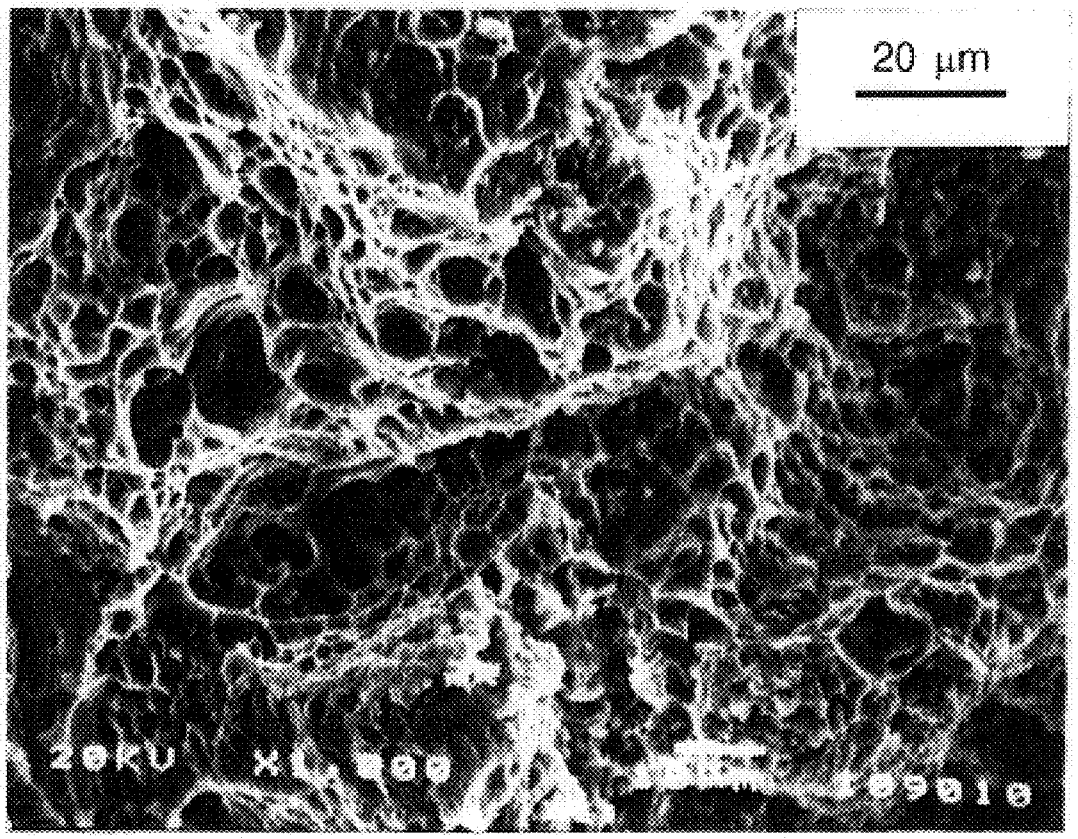
FIG. 5 is a photomicrograph of a sample showing complete sintering at 585° C.

Indeed, it was observed that densification proceeds by a capillary process, which depends on the extent of the oxide break-up and the contact angle between the particles. Loosely packed particles such as those shown in FIG. 2 were found to prevent sintering even at 625° C. (see FIG. 3), whereas no similar unsintered regions can be observed in the compacts pressed at 65° C. under 50 tsi (see FIG. 4), in which a complete sintering can be achieved at only 585° C. (FIG. 5).

EXAMPLE 4

According to the data given in Table 4, the best tensile properties were achieved with compacts pressed at 65° C. under 50 tsi and sintered at 625° C. Hence the same processing conditions were used to prepare the tempered compacts for tensile tests.

The degassed powder was pressed into 76 mm×12.7 mm×7 mm parallelepiped compacts and sintered in accordance with the aforementioned conditions. The sintered compacts were next solutionized at 520° C. for 30 minutes, water quenched, and aged at 160° C. for 18 hours. The tensile test was then carried out using the same tensile specimen type as in Example 3 machined from the sintered and tempered compacts. It has been found that the degassed 6061 Al prealloyed powder, compacted, sintered and tempered as described hereinbefore, provides a material having a tensile strength exceeding 335 MPa, a yield strength of 283 MPa, and an elongation of 7%, which expanded only 0.20% in dimensions over the green compact dimensions. The sintered density was around 97% of theoretical because of a residual porosity resulting from the high degree of compaction of the green compacts and also from the initial porosity present in the as-received powder formed during atomization. By varying the powder size (coarse powder), reducing the initial porosity and changing the sintering gas atmosphere to a more soluble gas such as hydrogen or vacuum the tensile properties can be still further increased.

The above-described tensile test results are presented in Table 5 together with data reported in the literature for equivalent alloys processed via compaction and liquid phase sintering (LPS) of blended powders [1–3] or degassing and hot extrusion of a prealloyed 6061 Al powder [4]. As can be seen from Table 5, the tensile properties in both treated and untreated conditions of the sintered material prepared from the degassed prealloyed powder are significantly higher than those of the equivalent alloys processed via compaction and LPS of blended powders. The tensile properties achieved in the present study even compare very well with the extruded material in the untreated condition. However, the performance of the extruded and tempered material were somewhat higher than those of the present alloy. This difference is attributed to the higher density of the extruded material and also to the "work hardening" associated with the extrusion process.

TABLE 5

Sintered Tensile Properties of Degassed 6061 Al Prealloyed Powder, Comparison with Equivalent Alloys Reported in Literature

| Alloy Composition wt % | Method of Preparation | Thermal Condition | Tensile Strength MPa | Yield Strength MPa | Elongation % |
|---|---|---|---|---|---|
| 1.0Mg—0.7Si—0.26Cu | Compact. and | T1 | 169 | 81 | 22 |
| Present Study | SLPS | T6 | 335 | 283 | 7 |
| 1.0Mg—0.6Si—0.25Cu | Compact. and | T1 | 110 | 48 | 6 |
| Ref. [1] | LPS | T6 | 252 | 241 | 2 |
| 1.0Mg—0.5Si—0.20Cu | Compact. and | T1 | 140 | / | 5 |
| Ref. [2] | LPS | T6 | 260 | / | 3 |
| 1.0Mg—0.6Si—0.25Cu | Compact. and | T1 | 124 | 58 | 8 |
| Ref. [3] | LPS | T6 | 252 | 241 | 2 |
| 1.0Mg—0.6Si—0.25Cu* | Compact. and | T1 | 134 | 53 | 11 |
| Ref. [3] | LPS | T6 | 269 | 261 | 2 |

TABLE 5-continued

Sintered Tensile Properties of Degassed 6061 Al Prealloyed Powder, Comparison with Equivalent Alloys Reported in Literature

| Alloy Composition wt % | Method of Preparation | Thermal Condition | Tensile Strength MPa | Yield Strength MPa | Elongation % |
|---|---|---|---|---|---|
| 1.0Mg—0.6Si—0.25Cu | Degassing and | T1 | 171 | 89 | 25 |
| Ref. [4] | hot extrusion | T6 | 392 | 367 | 14 |

* - Blended powder without internal lubricant
T1 - As sintered
T6 - Heat treat 30 min. 520 C., cold water quench, and age 18 hours ar 160 C.
SLPS - Supersolidus Liquid Phase Sintering

REFERENCES

1. J. H. Dudas, W. A. Dean, "The Production of Precision Aluminum P/M Parts", *Int. J. Powder Met.,* 1969, vol. 5, no. 2, p.21.

2. H. C. Neubling, G. Jangg, "Sintering of Aluminum Parts: The State-of-the-Art", *Metal Powder Report,* 1987, vol. 42, no. 5, p. 354.

3. I. D. Radomysel'skii, V. A. Dovydenkov, A. V. Dovydenkova, A. I. Klimenk, "Methods of Manufacture and Properties of P/M Aluminum Alloys", *Poroshkovaia Metallurgia,* 1984, vol.6, p.82.

4. A. Jokinen, V. Rauta, B. Wiik, T. Uuttu, M Säynätjoki, "Fabrication and Properties of Powder Metallurgical and Cast Aluminum Alloy Matrix Composite Products", 1992, *Valtion Teknillinen Tutkimuskeskus Publicatins* 127, Technical Research Centre of Finland, Espoo, Finland.

The examples given herein confirm that degassing of aluminum or prealloyed aluminum powder greatly improves the sinterability of green compacts produced therefrom. Furthermore, it is seen that if the degassing process is conducted generally in accordance with the steps of Example 1, i.e.—by allowing the degassed powder to cool to room temperature under a vacuum of $10^{-4}$ to $5\times10^{-6}$ torr, it is possible to sinter the green compacts produced by the process without hot working and at a point in time substantially later than is possible with the prior art.

Although the examples given herein indicate desired conditions for degassing and sintering it is expected that the processes defined herein will operate under broader conditions of temperature and pressure than those utilized in the examples. It is expected that the degassing temperature can be in the range of about 350° C. to about 450° C. and that the degassing pressure can be in the range of about $10^{-4}$ to about $5\times10^{-6}$ torr, although the preferred temperature and pressure are about 400° C. and $5\times10^{-6}$ torr respectively. It is also expected that compacting can be effected at pressures between about 20 and 60 tsi and at temperatures between room temperature (20° to 25° C.) to about 250° C. although the preferred parameters are a pressure of about 50 tsi and a temperature of about 65° C. The sintering temperature is best defined as being in the range between the solidus and liquidus temperatures for the aluminum or the given aluminum alloy.

The process of the present invention has wide applicability and can be utilized in preparing products from both precipitation-hardened or dispersion-hardened prealloyed aluminum powders.

We claim:

1. A process for preparing compacts from aluminum powder or prealloyed aluminum powder for later sintering comprising the steps of:

(a) heating a quantity of the powder in an autoclave to a degassing temperature of between about 350° and 450° C. at a pressure of about $5\times10^{-2}$ torr:

(b) reducing the pressure in the autoclave to a degassing pressure of about $10^{-4}$ to about $5\times10^{-6}$ torr and maintaining the temperature in the autoclave at the degassing temperature and pressure for about 2 hours in order to degas the powder;

(c) reducing the temperature in the autoclave to about room temperature while maintaining the pressure therein at the degassing pressure;

(d) removing the temperature-reduced powder from the autoclave; and (e) compacting the powder after temperature reduction at a pressure of about 20 to 60 tsi and at a temperature between about room temperature and 250° C.

2. The process of claim 1 wherein said degassing temperature is about 400° C. and the degassing pressure is about $5\times10^{-6}$ torr.

3. The process of claim 2 wherein said compacting step is performed at a pressure of about 50 tsi and a temperature of about 65° C.

4. A process of producing sintered aluminum alloy products comprising the steps of:

(a) producing a degassed aluminum or alloyed aluminum compact in accordance with claim 1; and (b) liquid phase sintering said compact in an inert gas atmosphere at a temperature in the range between the solidus and the liquidus temperatures for the given aluminum alloy.

5. The process of claim 4 wherein said inert gas is argon.

6. The process of claim 4 including the step of tempering the sintered product.

* * * * *